US005508723A

United States Patent [19]

Maeda

[11] Patent Number: 5,508,723

[45] Date of Patent: Apr. 16, 1996

[54] ELECTRIC FIELD POTENTIAL CONTROL DEVICE FOR AN IMAGE FORMING APPARATUS

[75] Inventor: Masataka Maeda, Konan, Japan

[73] Assignee: Brother Kogyo Kabushiki Kaisha, Nagoya, Japan

[21] Appl. No.: 352,763

[22] Filed: Dec. 2, 1994

Related U.S. Application Data

[63] Continuation-in-part of Ser. No. 112,471, Aug. 27, 1993.

[30] Foreign Application Priority Data

| | | | |
|---|---|---|---|
| Sep. 1, 1992 | [JP] | Japan | 4-233522 |
| Sep. 24, 1992 | [JP] | Japan | 4-254494 |
| Feb. 24, 1994 | [JP] | Japan | 6-026459 |

[51] Int. Cl.[6] ..... B41J 2/06

[52] U.S. Cl. ..... 347/55

[58] Field of Search ..... 347/55

[56] References Cited

U.S. PATENT DOCUMENTS

| | | | |
|---|---|---|---|
| 3,689,935 | 9/1972 | Pressman et al. | 347/55 |
| 4,491,855 | 1/1985 | Fujii et al. | 347/55 |
| 4,743,926 | 5/1988 | Schmidlin et al. | 347/55 |
| 4,755,837 | 7/1988 | Schmidlin et al. | 347/55 |
| 4,780,733 | 10/1988 | Schmidlin | 347/55 |
| 4,814,796 | 3/1989 | Schmidlin | 347/55 |
| 4,912,489 | 3/1990 | Schmidlin | 347/55 |
| 5,036,341 | 1/1991 | Larsson | 347/55 |
| 5,038,159 | 8/1991 | Schmidlin et al. | 347/55 |
| 5,095,322 | 3/1992 | Fletcher | 347/55 |
| 5,200,769 | 4/1993 | Takemura et al. | 347/55 |
| 5,229,794 | 7/1993 | Honma et al. | 347/55 |
| 5,231,427 | 7/1993 | Ohashi | 347/55 |

FOREIGN PATENT DOCUMENTS 0587366 3/1994 European Pat. Off. .

*Primary Examiner*—Peter S. Wong
*Assistant Examiner*—Randy W. Gibson
*Attorney, Agent, or Firm*—Oliff & Berridge

[57] ABSTRACT

An image forming apparatus includes a back electrode roller which is rotatably disposed on the upper side of an aperture electrode member. A toner carrier roller is disposed on the lower side of the aperture electrode member. The aperture electrode member is constructed such that a plurality of apertures are defined in a row in an insulating sheet and each of a plurality of control electrodes is formed on the upper side of each aperture. A control voltage applying circuit applies a voltage of 0 V or −100 V to each of the control electrodes based on an image signal. A DC power source is electrically connected to the back electrode roller. Toner particles on the toner carrier roller fly under the action of an electric field formed by the back electrode roller. A voltage of −100 V applied to each of the control electrodes prevents the toner particles from flying when no image pixels are to be formed. The voltages are applied to the control electrodes of the aperture electrode members such that an electric field is formed which prevents the charged toner particles from being deposited on the control electrodes. Thus, a higher quality image is formed on a support member.

8 Claims, 11 Drawing Sheets

ELECTRIC FIELD POTENTIAL CONTROL DEVICE FOR AN IMAGE FORMING APPARATUS

This invention is a continuation-in-part of U.S. application Ser. No. 08/112,471, filed Aug. 27, 1993, the disclosure of which is incorporated herein by reference in its entirety.

BACKGROUND OF THE INVENTION

1. Field of the Invention

This invention relates to an electrostatic image forming apparatus usable in a copying machine, a printer, a plotter, a facsimile machine, etc. In particular, this invention relates to a control device for controlling an applied electric field in the image forming apparatus.

2. Description of the Related Art

A conventional electric field image forming apparatus is disclosed in U.S. Pat. No. 3,689,935. This conventional image forming apparatus has electrodes having a plurality of openings (hereinafter called "apertures"), wherein a voltage is applied to each of the electrodes based on image data. Toner particles are controlled by the voltage to pass through the apertures. Thus, images are formed on a support member using the toner particles that have passed through the apertures.

An aperture electrode of this conventional image forming apparatus comprises a plate made of an insulating material, a continuous reference electrode formed on one side of the plate, a plurality of mutually-insulated control electrodes formed on the other side of the plate, the aperture electrode member having at least one row of apertures formed by extending through the above three components. This conventional image forming apparatus further comprises means for selectively applying electric potentials between the reference electrode and each of the control electrodes, means for supplying or providing electrostatically charged toner particles so that flows of the charged toner particles passing through the respective apertures are modulated by the applied electric potentials, and means for positioning the support member in the path of the flow of the toner particles, such that the support member is movable relative to the aperture electrode member.

In this conventional image forming apparatus, the reference electrode of the aperture electrode member faces the toner carrier and the control electrodes face the back electrode. To supply negatively charged toner particles from the toner carrier to the support member, a first control voltage is applied to each "on" control electrode, and a second voltage is applied to each "off" control electrode. Thus, when the apparatus is turned on, the toner particles on the toner carrier roller are introduced into the support member side of the aperture electrode member through the apertures corresponding to the "on" control electrodes.

In this apparatus, the first or on control voltage is positive, while the second or off control voltage is zero. When the apparatus is turned on, a positive voltage is applied to each "on" control electrode, so that an electrostatic force directed from the toner carrier to each "on" control electrode is established. Further, the toner particles are introduced onto the support member by an electric field developed between the support member and the aperture electrode member to thereby form a toner image. In contrast, when the apparatus is turned off, a voltage of 0 V is applied to each "off" control electrode, so that no electrostatic force directed toward the aperture electrode member or away from the toner carrier is established.

However, some toner particles will be deposited on the aperture electrode member without traveling toward the support member, due to the positive voltage applied to each "on" control electrode. In this case, some of the apertures will become clogged with the toner particles, thereby deteriorating the quality of the recorded image. Further, since no electric field is directly applied by the "off" control electrodes to the toner particles in the vicinity of the "off" control electrodes, the image recording apparatus is not completely controlled.

It should be appreciated that the term "when the apparatus is turned off" means when one or more of the apertures are turned off, so that the toner particles are not being applied to the support member through the off apertures, that is, when a blank image portion is being formed. On the other hand, it should be appreciated that the term "when the apparatus is turned on" means when one or more of apertures are on, so that the toner particles are applied to the support member and an image is formed on the support member.

SUMMARY OF THE INVENTION

This invention therefore provides an image forming apparatus wherein smudging of an image can be prevented, by preventing toner particles from remaining in the neighborhood of each of control electrodes, thereby making it possible to form a high-quality reproduced image.

In order to achieve the above object, one preferred embodiment of the image forming apparatus of this invention includes toner-flow controlling means having a plurality of control electrodes and a toner carrier for supplying charged toner particles to the toner-flow controlling means. The first preferred embodiment of the image forming apparatus is constructed such that the passage of the toner particles, which are supplied from the toner carrier through the toner-flow controlling means, is controlled to form an image on a support member, which is disposed on the opposite side of the toner carrier, with the toner-flow controlling means interposed between the toner carrier and a back electrode, and with the support member disposed between the toner carrier and the back electrode. In the image forming apparatus, flying of the toner particles from the toner carrier to the support member is produced under the action of an electric field formed by the back electrode. A control voltage is applied to each of the control electrodes such that flying of the toner particles is avoided by an electric field formed by each control electrode.

According to the first preferred embodiment of the image forming apparatus of this invention having the above construction, when the image forming apparatus is turned on, only an electrostatic force directed toward the supporting member is applied to the toner particles. The electrostatic force is generated by a first electric field formed by the voltage applied to the back electrode. The electrostatic force causes the toner particles to fly toward the support member to form the image. Since, at this time, no electric field is produced which points toward the control electrodes, the toner particles do not fly toward the control electrodes. Upon turning off the apparatus, a voltage is applied to each control electrode to form a second electric field. The second electric field generates an electrostatic force directed toward the toner carrier, and the toner particles are exposed to this electrostatic force. At this time, the toner particles on the toner carrier remain on the toner carrier, so that the flow of the toner particles is prevented.

According to the first preferred embodiment of the image forming apparatus of this invention, as is apparent from the above description, the toner particles are not deposited on the control electrodes when forming the image. As a result, the formed image is not smudged by the toner particles. Thus, the image forming apparatus is provided which is capable of forming an excellent quality image.

The above and other objects, features and advantages of this present invention will become apparent from the following description and the appended claims, taken in conjunction with the accompanying drawings in which preferred embodiments of the present invention are shown by way of illustrative example.

BRIEF DESCRIPTION OF THE DRAWINGS

The preferred embodiments of this invention will be described in detail, with reference to the following figures, wherein:

FIG. 5 is a graph of the distribution of the electric field potential developed in the neighborhood of each aperture employed in the image forming apparatus shown in FIG. 1 when the image forming apparatus is turned on;

FIG. 7 is a graph of the distribution of the electric field potential developed in the vicinity of each aperture employed in a conventional image forming apparatus when the conventional image forming apparatus is turned on;

DETAILED DESCRIPTION OF THE PREFERRED EMBODIMENTS

Figure 1:
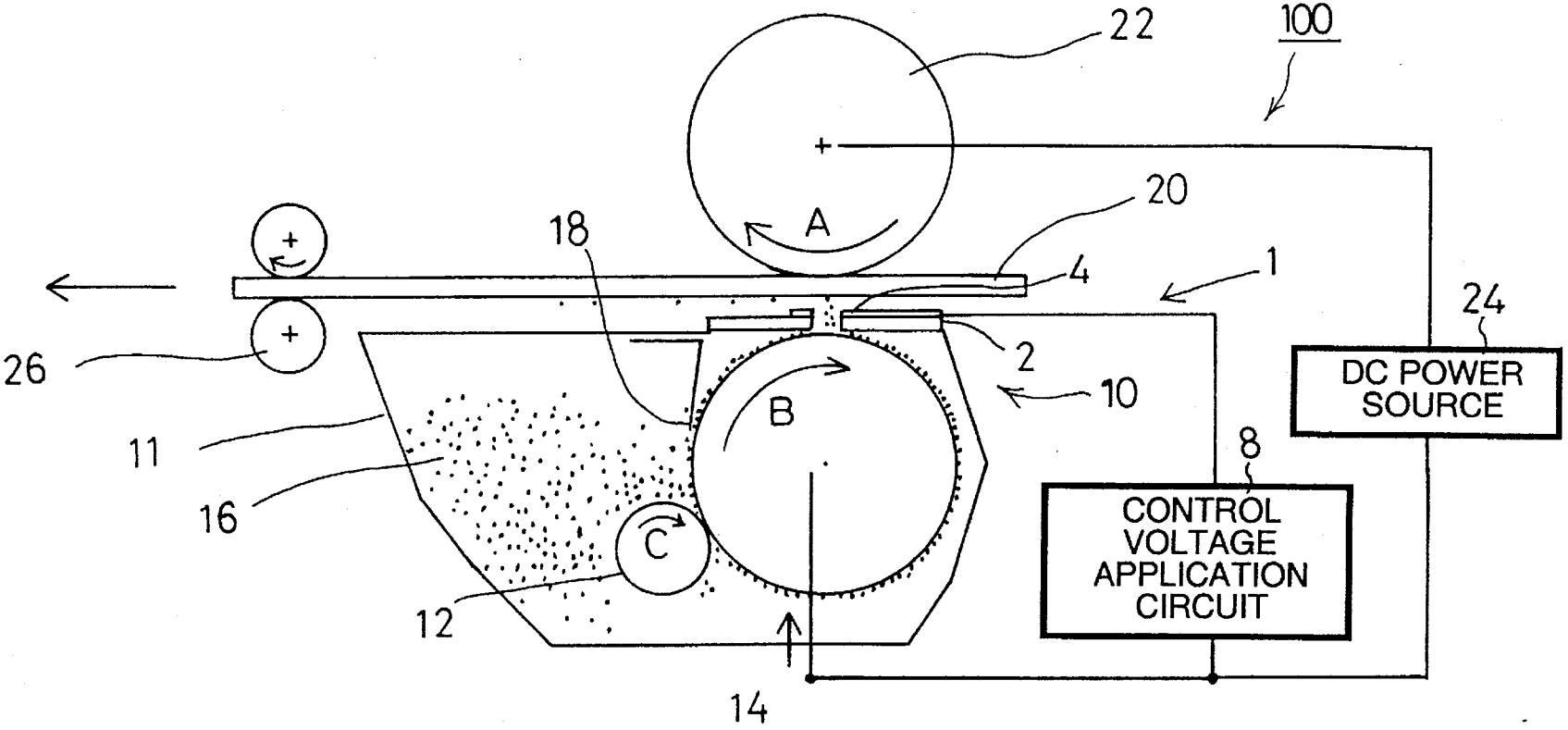
FIG. 1 is a cross-sectional view showing one embodiment of an image forming apparatus of this invention.

FIG. 1 shows a first preferred embodiment of an image forming apparatus 100 comprising a cylindrical back electrode roller 22 forming a back electrode, which is positioned 0.1 mm from the upper side of an aperture electrode member 1, which is used as a toner-flow controlling means. The cylindrical back electrode roller 22 is rotatably mounted on a chassis (not shown). The cylindrical back electrode roller 22 is constructed to convey a support member 20 inserted into the 0.1 mm gap between the cylindrical back electrode member 22 and the aperture electrode member 1 along a direction A. A toner supply device 10 is positioned on the lower side of the aperture electrode member 1 and aligned with the longitudinal direction of the aperture electrode member 1. A fixing device 26 is positioned in the direction A downstream of the back electrode roller 22.

The toner supply device 10 comprises a toner casing 11 that doubles as a housing for the entire device, a mass of toner particles 16 accommodated within the toner casing 11, a toner feed roller 12, a toner carrier roller 14, and a toner-layer restriction blade 18. In the toner supply device 10, the toner carrier roller 14 is made of metal and serves as a reference electrode. Further, the toner carrier roller 14 holds the mass of toner particles 16 and conveys the mass of toner particles 16 to the aperture electrode member 1. The toner feed roller 12 feeds the mass of toner particles 16 to the toner carrier roller 14. The mass of toner particles 16 is an insulating mass of toner having electrical insulating characteristics.

The toner carrier roller 14 and the toner feed roller 12 are rotatably supported by the toner casing 11, and rotate in the directions B and C, respectively. The toner feed roller 12 and the toner carrier roller 14 are disposed in parallel with each other and are in rolling contact with each other. The toner-layer restriction blade 18 adjusts the amount of the toner particles 16 carried by the toner carrier roller 14 to assure a uniform layer of the toner particles 16 is formed on the surface of the toner carrier roller 14. Toner feed roller 12 causes the toner particles 16 to be uniformly charged on the surface of the toner carrier roller 14. The toner-layer restriction blade 18 thus presses against the toner carrier roller 14.

Figure 2:
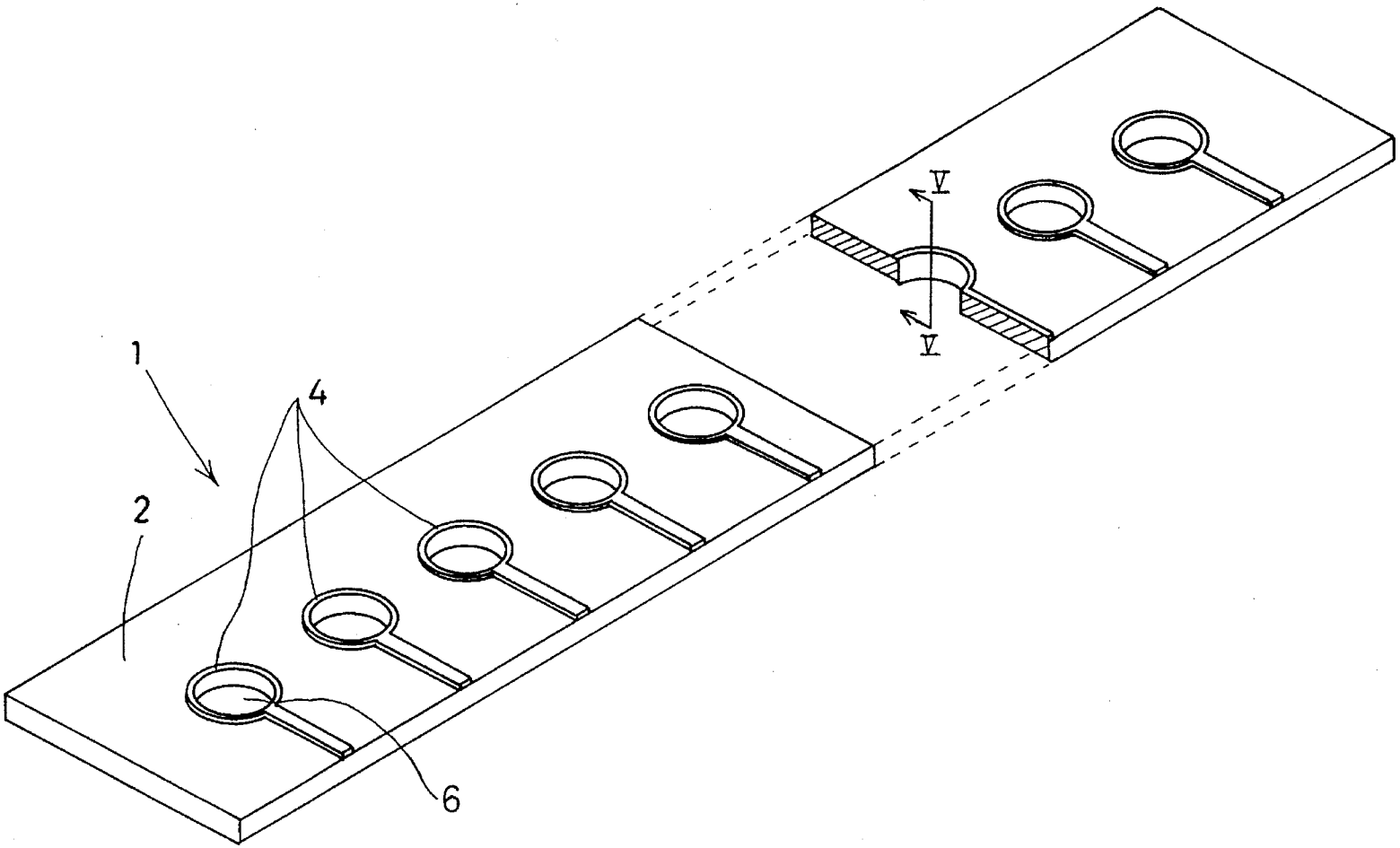
FIG. 2 is a perspective view of an aperture electrode member of the image forming apparatus shown in FIG. 1.

As shown in FIG. 2, the aperture electrode member 1 has a plurality of apertures 6, each having a diameter of approximately 100 μm. The apertures 6 are placed in a row in an insulating sheet 2. The insulating sheet 2 has a thickness of approximately 25 μm and is formed from polyamide. Control electrodes 4, each having a thickness of 1 μm, are respectively formed on the upper side of the insulating sheet 2 around the apertures 6. The control electrodes 4 and the apertures 6 form the toner-flow controlling section of this invention. The aperture electrode member 1 is positioned such that the control electrodes 4 are adjacent to the support member 20 and such that the insulating sheet 2 is held in rolling contact with the toner particles 16 on the toner carrier roller 14, as shown in FIG. 1.

Figure 3:
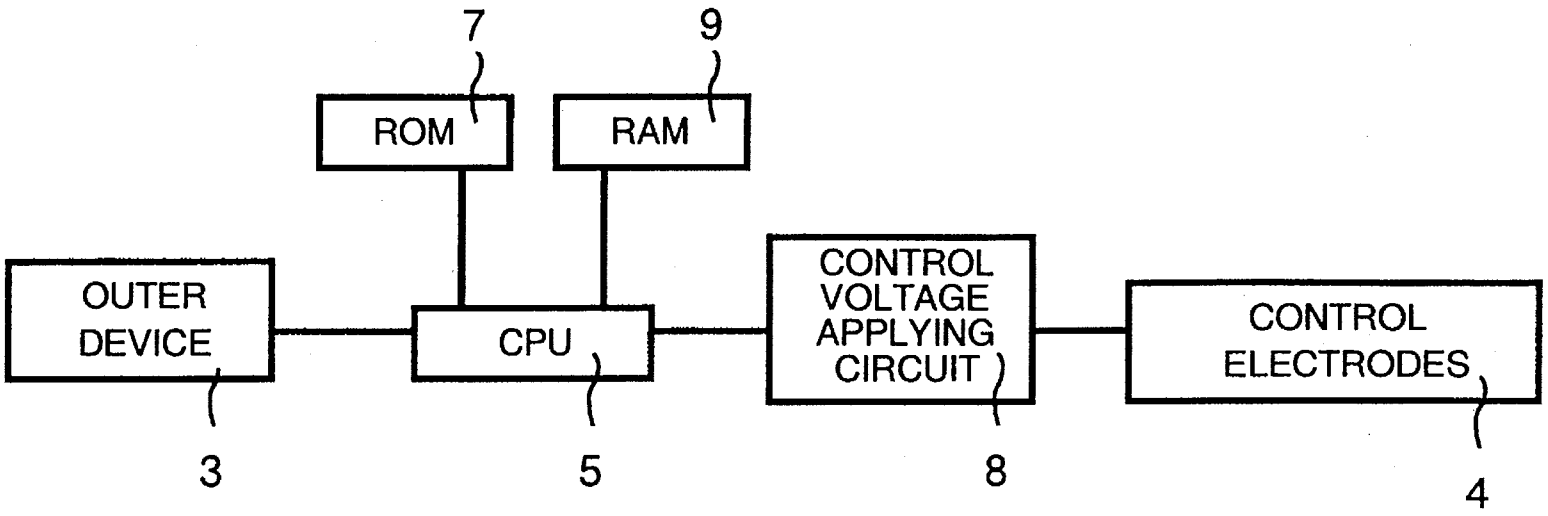
FIG. 3 is a block diagram of a control voltage applying circuit employed in the image forming apparatus shown in FIG. 1.
Figure 4:
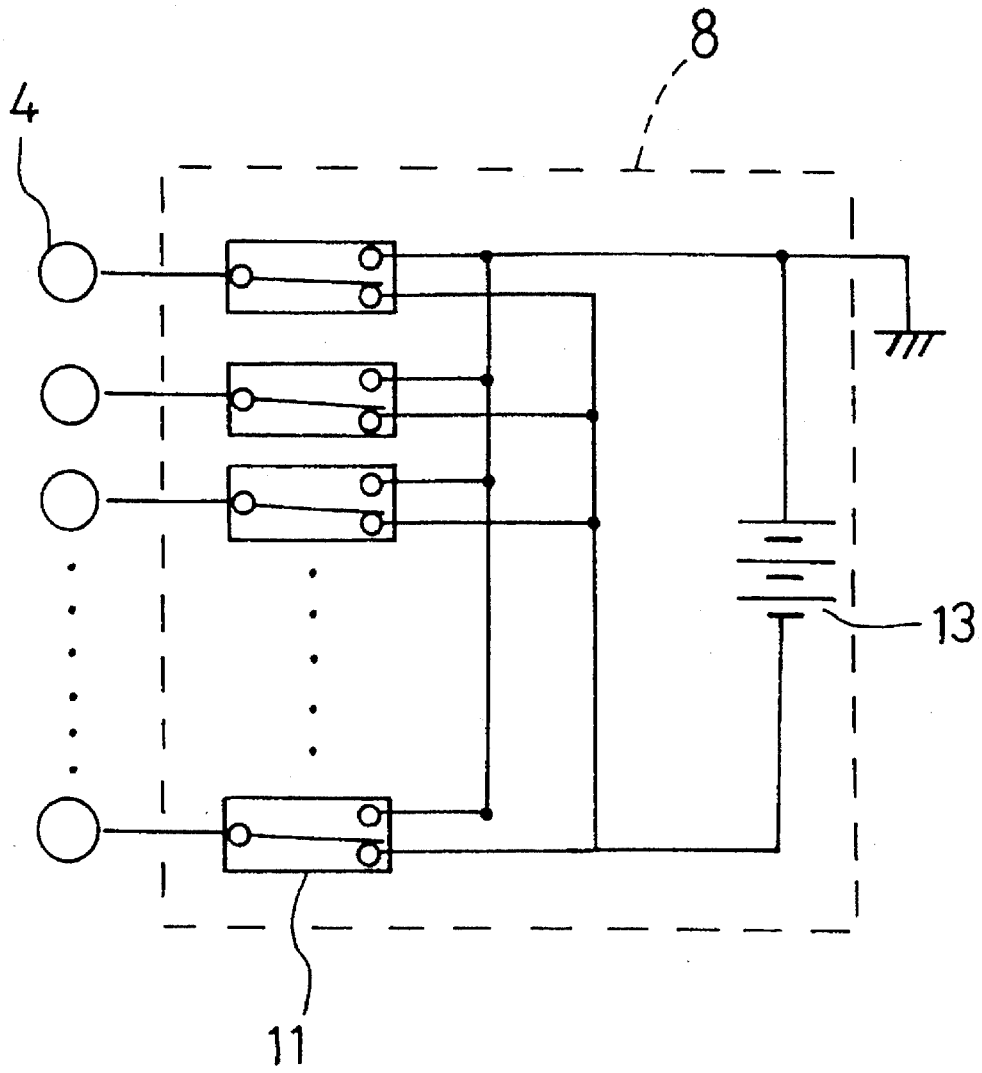
FIG. 4 shows the control voltage applying circuit used in the image forming apparatus shown in FIG. 1.

A control voltage applying circuit 8, which serves as a control voltage applying means, is electrically connected between the control electrodes 4 and the toner carrier roller 14. As shown in FIG. 3, an image signal, input from an external device 3, is stored in a RAM 9 through a control means (CPU) 5 and is output to the control voltage applying circuit 8 through the control means (CPU) 5. As shown in FIG. 4, the control voltage applying circuit 8 comprises a plurality of switching elements 11, each connected in parallel to a DC power source 13. The switching elements 11 can comprise any conventional switch, including electromechanical switches, electrical switches, and electronic switches. Preferably, the switching elements 11 are transistors. The control voltage applying circuit 8 is controlled by the control means 5 to individually apply a voltage of 0 V or −100 V to each control electrode 4, based on the image signal.

A DC power source 24, which serves as a back electrode power source, is electrically connected between the back electrode roller 22 and the toner carrier roller 14. The DC power source 24 applies a voltage of +150 V to the back electrode roller 22.

Initially, the toner particles 16, which are fed from the toner feed roller 12 to the toner carrier roller 14, are rubbed against the toner carrier roller 14 as the toner carrier roller 14 and the toner feed roller 12 rotate in directions B and C, respectively, as shown in FIG. 1. As a result, the toner particles 16 are negatively charged and held or carried on the toner carrier roller 14. After the carried toner particles 16 have been reduced to a thin layer by the toner-layer restriction blade 18, the toner particles 16 are conveyed to the aperture electrode member 1 by the rotation of the toner carrier roller 14. The toner particles 16 on the toner carrier roller 14 are then rubbed against the insulating sheet 2 of the aperture electrode member 1 and are discharged into the apertures 6 under the action of a frictional force produced by the rubbing action between the toner carrier roller 14 and the aperture electrode member 1.

The control voltage applying circuit 8 selectively applies a voltage of 0 V to given ones of the control electrodes 4, corresponding to image portions of the image signal, and a voltage of −100 V to other ones of the control electrodes 4, corresponding to non-image, or blank portions, of the image signal. As a result, a line of electric force traveling from the back electrode roller 22 to the toner carrier roller 14 is produced within each aperture 6 corresponding to the image portions by a difference in the electric potential between the back electrode roller 22 and the toner carrier roller 14. Thus, the negatively charged toner particles 16 are exposed to an electrostatic force in a high potential direction and fly from the toner carrier roller 14 to the back electrode roller 22 through the aperture 6, so that the toner particles 16 are deposited on the support member 20 to form image pixels.

Further, the control voltage applying circuit 8 applies a voltage of −100 V to the control electrodes 4 corresponding to the non-image portions. As a result, a line of electric force traveling to the toner carrier roller 14 from the control electrode 4 is formed within the corresponding apertures 6 to return the negatively charged toner particles 16 discharged into the corresponding apertures 6 back to the toner carrier roller 14.

During the formation of each line of pixels on the surface of the support member 20 by the toner particles 16, the toner particles 16 corresponding to one pixel are fed to the support member 20 along the direction perpendicular to the row of the apertures 6. By repeating the above process, a toner image is formed over the entire surface of the support member 20. Thereafter, the formed toner image is fixed onto the support member 20 by the fixing device 26.

Figure 5:
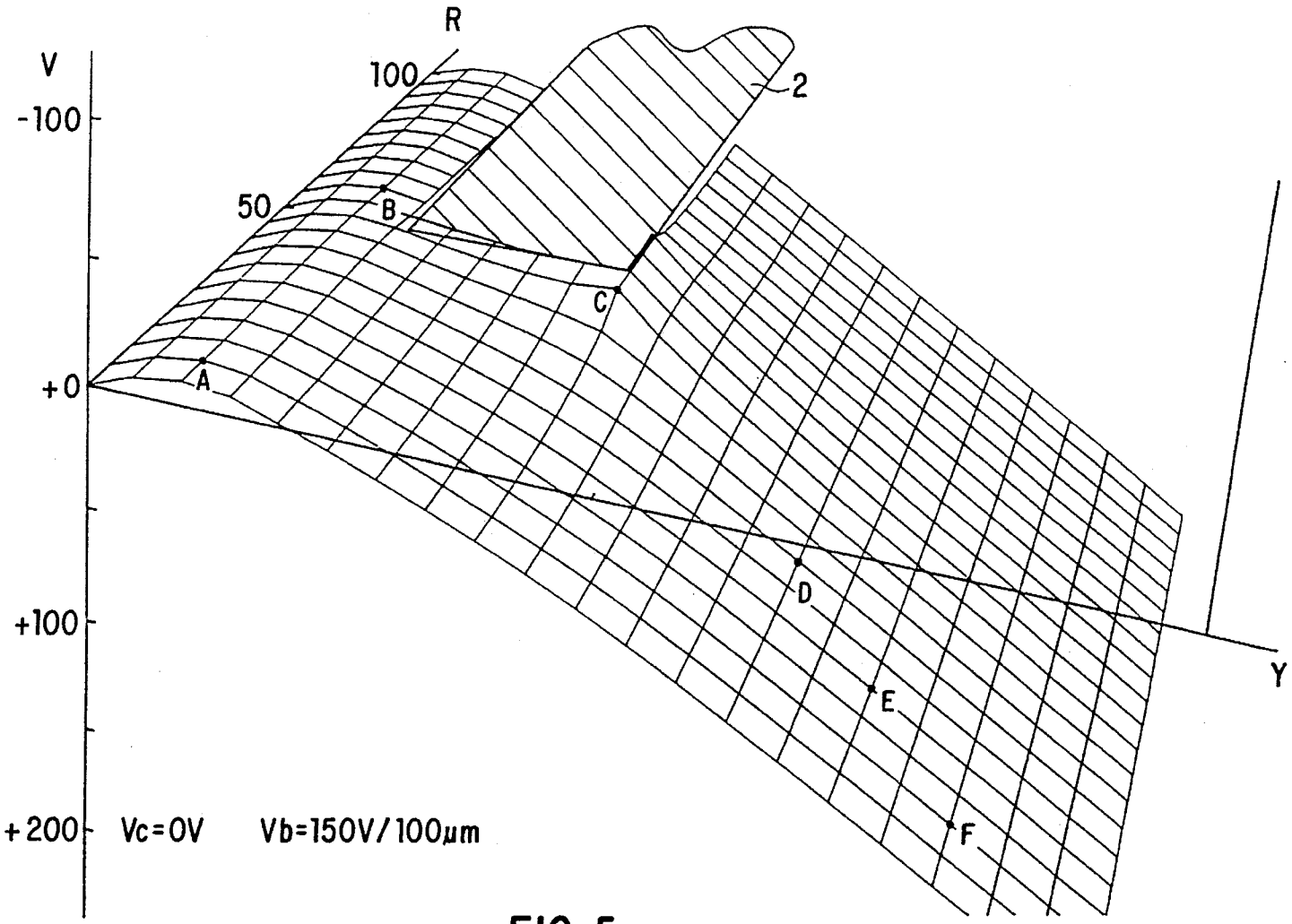

FIG. 5 shows the distribution of the electric field potential in the vicinity of each aperture 6 corresponding to an image portion, i.e., when the image forming apparatus is turned on. FIG. 5 shows the electric field potential in the neighborhood of each "on" aperture 6. The Y axis is positioned along the cylindrical axis of the aperture 6. The R axis represents the radial axis of the aperture 6. The cross-hatched area 2 represents the two-dimensional area of the insulating sheet 2. Since the insulating sheet 2 is insulative, no electric field is present in the area occupied by the insulative sheet 2. Thus for each two-dimensional slice of the aperture 6 extending radially along the axis R from the axis Y, the electric field generated by the control electrode 4 is shown in FIG. 5. The graph shown in FIG. 5 assumes the electric field potential is radially symmetrical about the Y axis.

Since the toner particles 16 are negatively charged, they are repelled from the negative potential portions of the electric field and are attracted to the positive potential portions of the electric field. In addition, the more positive or negative the electric field becomes, the more strongly the toner particles 16 are respectively attracted or repelled. Thus, as shown in FIG. 5, the negatively charged toner particles 16 will tend to move from the negative potential portions of the electric field, such as points A–C, toward the positive potential portions of the electric field, such as points D–F. Accordingly, the negative portions of the electric field are shown above the positive portions of the electric field, with the toner particles moving from high positions in the electric field to low positions.

In addition, as shown in FIG. 5, the potential of the electric field becomes more positive (lower) moving along the radial axis R toward the cylindrical axis Y of the aperture 6, and along the cylindrical axis Y from the toner carrier roller 14 towards the back electrode roller 22. Therefore, the toner particles are repelled from the control electrode 4 and thus do not become deposited in the vicinity of each control electrode 4.

Figure 6:
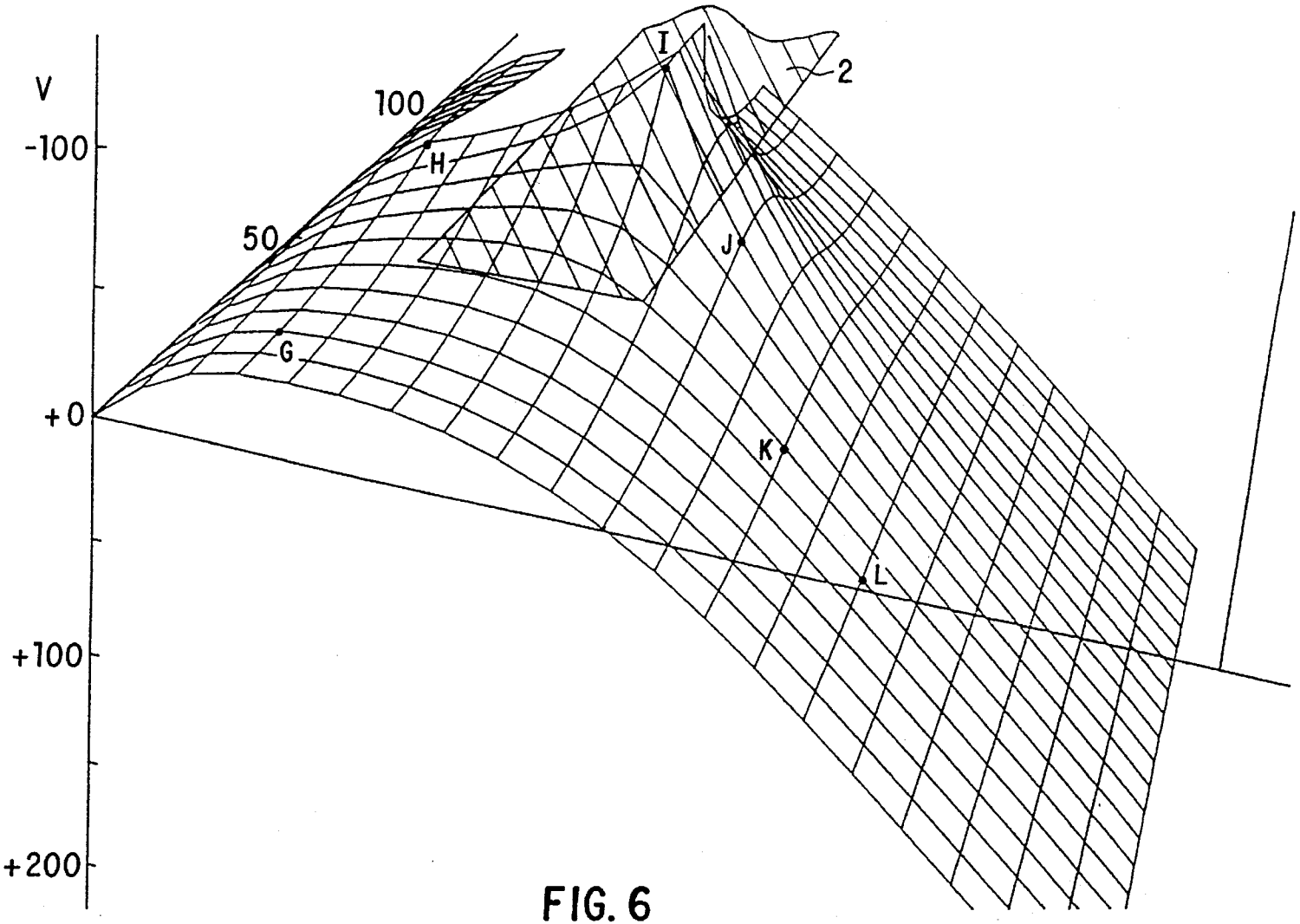
FIG. 6 is a graph of the distribution of the electric field potential developed in the neighborhood of each aperture used in the image forming apparatus when the image forming apparatus is turned off.

FIG. 6 shows the distribution of the electric field potential of a non-image portion, i.e., the distribution of potential in the vicinity of each aperture 6 corresponding to the non-image portions when the aperture 6 of the image forming apparatus 100 is turned off. As shown in FIG. 6, the potential of the electric field at the control electrode is of the lowest potential (highest in the drawing) and the negatively charged toner particles 16 are strongly repelled from the control electrode 4, so they do not concentrate on the control electrode 4.

That is, the electric field potentials shown in FIG. 6, like those shown in FIG. 5, are shown extending along the cylindrical axis Y and the radial axis R, and are radially symmetrical about the aperture 6. However, in FIG. 6, the negatively charged toner particles 16 carried on the toner carrier roller 14 experiences a much more negative electric field potential within the aperture 6 than that in the aperture 6 in FIG. 5. Thus, toner particles 16 at points G–I, for example, will tend to be repelled back toward the toner carrier roller 14, rather than toward points J–L. Again, as in FIG. 5, the potential of the electric field becomes more positive (lower) moving along the radial axis R toward the cylindrical axis Y and moving along the cylindrical axis Y from the aperture 6 towards the back electrode roller 22. Thus, few toner particles 16 will enter the aperture 6, and those that do are strongly repelled from the control electrodes 4 and the edges of the aperture 6 towards the axis Y and toward the back electrode 22. However, since fewer, if any, toner particles 16 can overcome the negative electric potential established within the aperture 6, few, if any, toner particles 16 are attracted to the back electrode roller 22.

Figure 7:
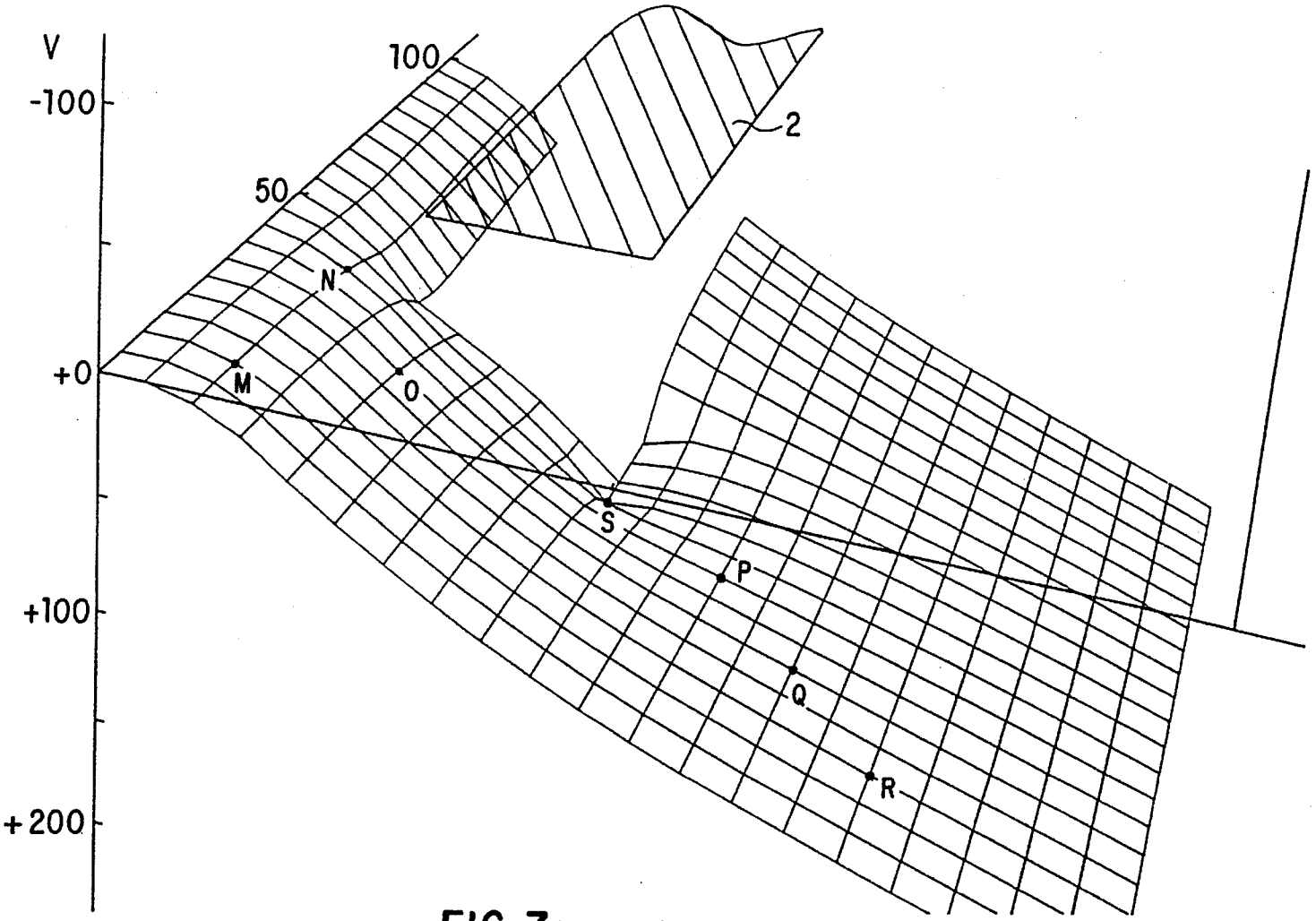
FIG. 7 PRIOR ART

On the other hand, FIG. 7 shows the distribution of the electric field potential in the vicinity of an aperture employed in the conventional image forming apparatus which uses negatively charged toner particles and in which a positive voltage has been applied to a control electrode. Since a positive voltage is applied to the control electrode, the negatively charged toner particles 16 carried on the toner carrier roller 14 experience a much more positive electric field potential within the aperture 6. Thus, toner particles 16 at points M–O, for example, will tend to be attracted from the toner carrier roller 14 toward points P–R and ultimately towards the back electrode roller 22.

As shown in FIG. 7, there is a relative maximum positive electric potential within the aperture at point S (shown as a relative minimum). Accordingly, due to this relative maximum positive potential in the electric field, which is near the control electrode, some of the negatively charged toner particles 16 will be attracted to this relative maximum and be deposited on the control electrode 4.

The present invention is not necessarily limited to or by the first preferred embodiment which has been described above in detail. It will be apparent to those skilled in the art that many changes and modifications can be made without departing from the spirit or scope of the invention as set forth herein.

Figure 8:
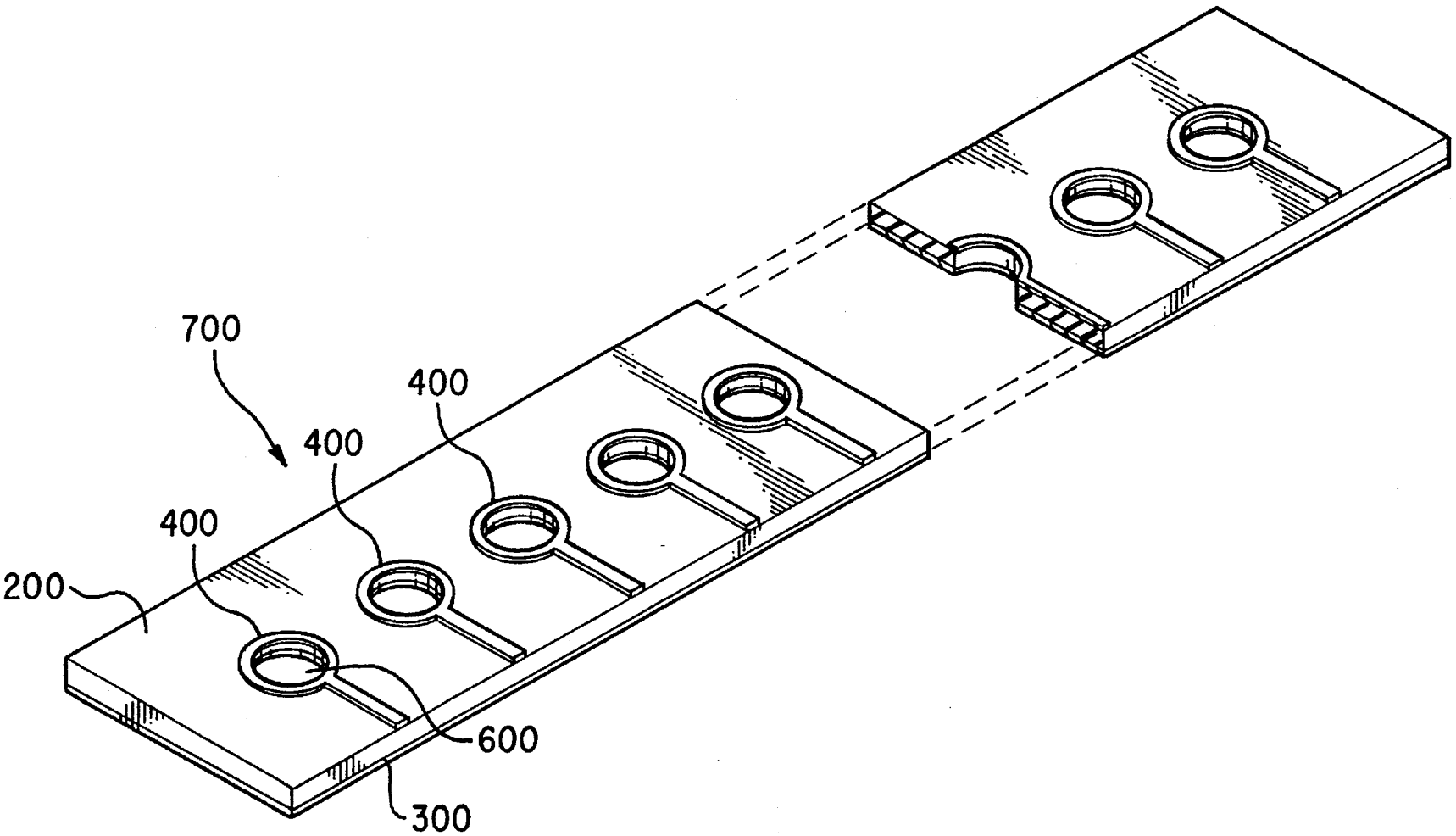
FIG. 8 is a perspective view showing another embodiment of the aperture electrode member.

As shown in FIG. 8, in a second embodiment of the aperture electrode member, the aperture electrode member 700 has a plurality of aperture 600. Each aperture 600 has a diameter of approximately 100 μm and the apertures 600 are arranged in a single-file row on the insulating sheet 200. The insulating sheet 200 has a thickness of approximately 25 μm and is made of polyimide. One control electrode 400 is formed around each aperture 600 on an upper side of the insulating sheet 200. The control electrodes 400 each have a thickness of approximately 1 μm. A reference electrode 300 is formed on a bottom of surface of the insulating sheet 200 and extends over the entire surface of the insulating sheet 200.

Figure 9:
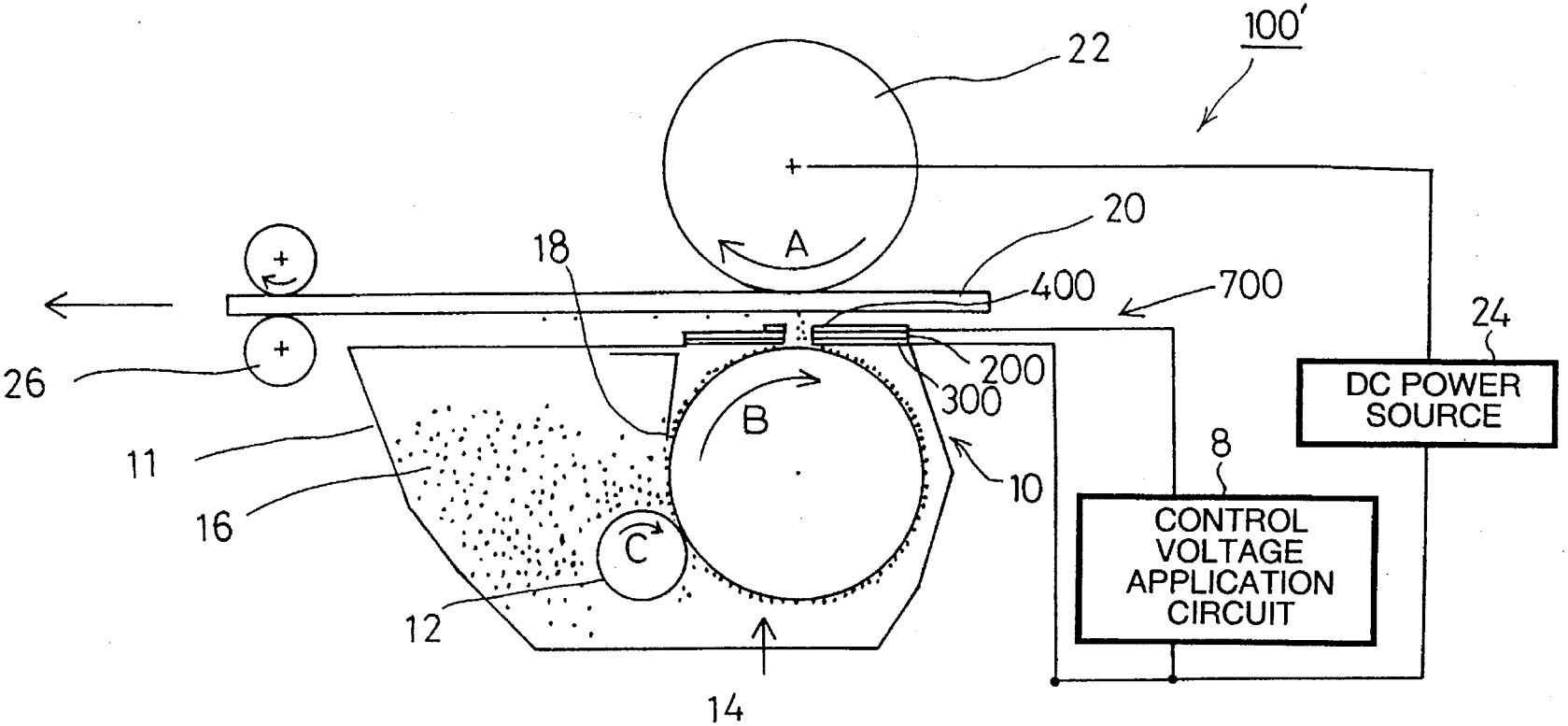
FIG. 9 is a cross-sectional view of another embodiment of an image forming apparatus of this invention.

As shown in FIG. 9, the aperture electrode member 700 is incorporated into the image forming apparatus 100' in the following manner. The control electrodes 400 are disposed so as to be opposite to the support member 20. The reference electrode 300 is provided so that a slight gap is defined, at an aperture position, between the reference electrode 300 and the toner particles 16 on the toner carrier roller 14. Further, the control voltage applying circuit 8, which is used as a control voltage applying means, is electrically connected between the control electrodes 400 and the reference electrode 300. Further, the DC power source 24, which is used as a back electrode power source, is electrically connected between the back electrode roller 22 and the reference electrode 300.

In the first preferred embodiment, as described above, the control voltage applying circuit 8 applies a control voltage D of 0 volts to each on control electrode 4 corresponding to an image portion. In addition in a third preferred embodiment, as shown in FIG. 10, it is possible to apply a different voltage D greater than zero to each control electrode 4 from the control voltage applying circuit 8 when turning on each control electrode 4.

The different voltage D is applied if the different voltage D meets the following conditions. The voltage C, having a polarity opposite to the polarity of the charged toner particles 16, is applied to the back electrode roller 22 by the DC power source 24. In the first preferred embodiment described above, the voltage C is +150 V.

Figure 10:
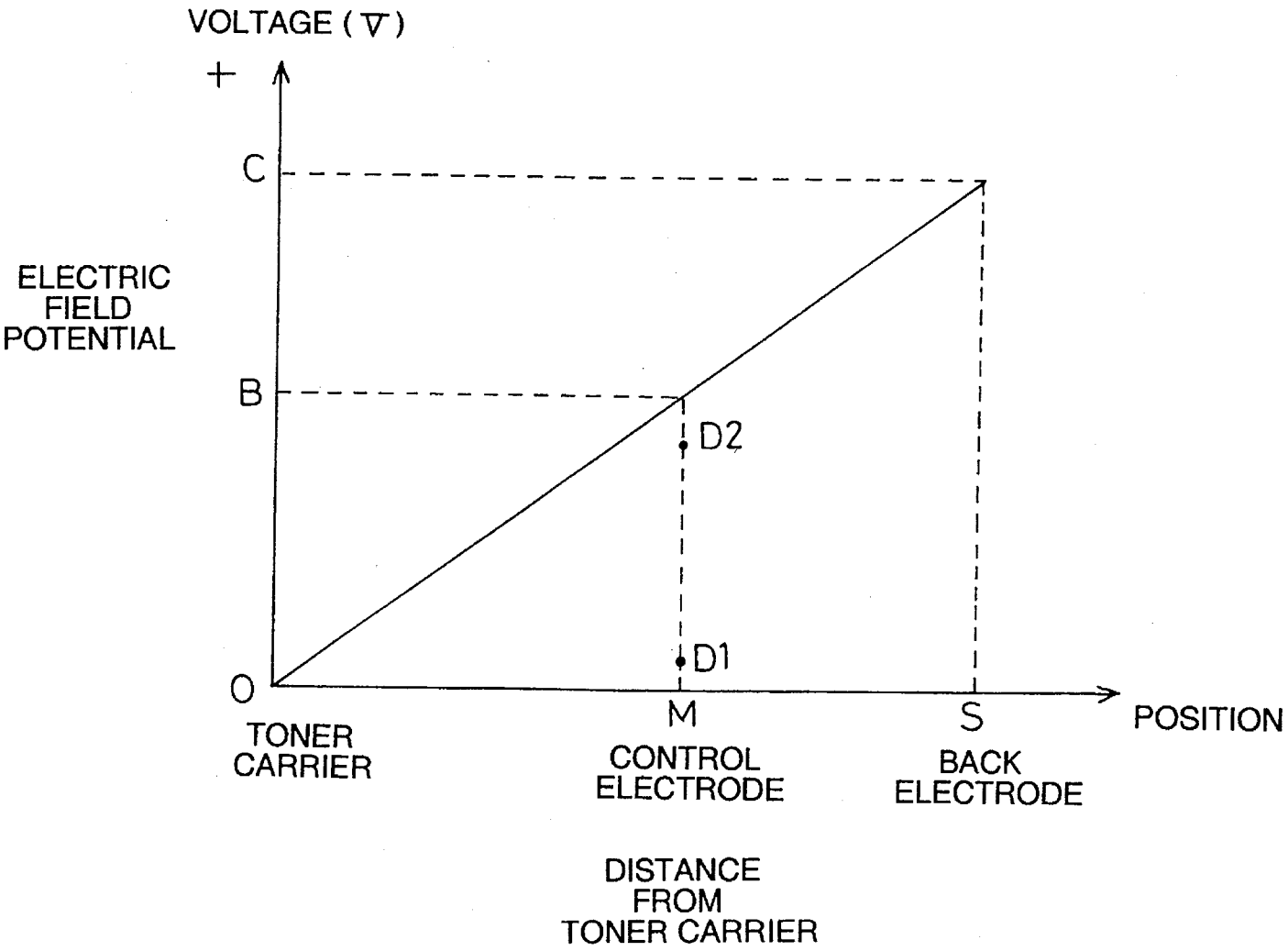
FIG. 10 is a graph showing the electric field potential gradient of a voltage applied to the back electrode roller as a function of distance from the toner carrier.

FIG. 10 shows the resulting electric field potential distribution or gradient along the Y axis from the toner carrier roller 14 to the back electrode 22 when the voltage C is applied to the back electrode roller 22. This potential distribution or gradient arises when no electrode aperture member 1 is provided between the toner carrier roller 14 and back electrode roller 22. The condition that must be met before the voltage D can be applied to the control electrodes 4 is that the voltage D applied to the control electrode 4 corresponding to image portions must be lower than the voltage B. The voltage B is the value of electric field potential, at the position corresponding to where the electrode aperture member 1 is actually placed, that results when the voltage C is applied to the back electrode roller 22, given the distribution of the electric field potential shown in FIG. 10.

That is, FIG. 10 shows the relationship between the potential of the electric field generated when the voltage C is applied to the back electrode roller 22, measured from the toner carrier roller 14. Thus, at the surface of the toner carrier roller 14, the resulting electric field potential is zero, while at the surface of the back electrode roller 22, the resulting electric field potential is C.

The different voltage D may be determined from the diameter of the apertures 6 and from the depth of the apertures 6 (i.e., the thickness of the aperture electrode member 1). In general, as the diameter of the apertures 6 becomes large, the different voltage D can be reduced. Likewise, as the thickness of the aperture electrode member 1 becomes thinner, the different voltage can again be reduced.

For example, as shown in FIG. 10, when the apertures 6 have a large diameter and the aperture electrode member is thin, the different voltage D can be approximately D1. Because the apertures 6 are large and the aperture electrode member 1 is thin, most of the electric field generated between the back electrode roller 22 and the toner carrier roller 14 is able to easily pass through the apertures 6. Since this electric field is not blocked by the aperture electrode member 1, the toner particles 16 on the toner carrier roller 14 see this electric field, and are attracted to the back electrode roller 22 by it. Thus, another electric field is either not necessary, or only a very small electric field is required.

In contrast, as the diameter of the apertures 6 becomes small, the different voltage D must be increased. Likewise, as the thickness of the aperture electrode member 1 becomes thicker, the different voltage must again be increased.

For example, as shown in FIG. 10, when the apertures 6 have a small diameter and the aperture electrode member is thick, the different voltage D must be approximately D2. Because the apertures 6 are small and the aperture electrode member 1 is thick, the electric field generated between the back electrode roller 22 and the toner carrier roller 14 is not able to easily pass blocked by the aperture electrode member 1 the toner particles 16 on the toner carrier roller 14 are not able to see this electric field, and thus would not otherwise attracted to the back electrode roller 22. Thus, another electric field is necessary. This additional electric field is supplied by applying the different voltage D2 to the control electrodes.

Accordingly, in this third preferred embodiment the image forming apparatus may further include means for determining the potential B at the position of the electrode aperture member 1 resulting from the voltage C, which is applied to the back electrode roller 22 by the DC power source 22. The determining means can comprise a dedicated hardware circuit, a lookup table stored in the ROM 7 or a software program implemented in the CPU 5. Then, the control voltage applying circuit 8 can apply any voltage D between 0 volts and B volts to the control electrodes 4.

Of course, it should be appreciated that if the voltage C applied to the back electrode roller 22 is fixed, and the positions of the toner carrier 14, the electrode aperture member 1 and the back electrode roller 22 are also fixed, the voltage B is known and is also fixed. In this case, the determining means can be eliminated. Alternately, the voltage D can be predetermined, for example as a factory setting, by determining the voltage B, and possibly the average aperture diameter and the aperture electrode member thickness, and selecting the optimum voltage D accordingly.

For example, if the control electrode 4 is placed at position M between the toner carrier roller 14 and the back electrode roller 22, the electric potential at position M due to the voltage C is B volts. Thus, the control voltage D applied to the control electrodes 4 for the image portions by the control voltage applying circuit 8 can be any positive voltage which is greater than zero volts and less than or equal to B volts. This is shown in Eq. 1:

$$T \leqq D \leqq [M(B-T)/S]+T \quad (1)$$

where T is the absolute electric potential applied to the toner carrier roller 14, D is the control voltage applied to the on control electrodes 4, M is the distance between the toner carrier roller 14 and the electrode aperture member 1, B is the absolute electric potential applied to the back electrode roller 22, and S is the distance between the toner carrier roller 14 and the back electrode roller 22. If the absolute electric potential of the toner carrier roller 14 is defined as zero, that is, the voltages D and B are measured relative to the voltage of the toner carrier roller 14, then Eq. 1 becomes:

$$0 \leqq D \leqq [M*B/S] \quad (2)$$

It should also be appreciated that, when the toner is positively charged, the direction in which the inequality signs (≦) point in Eq. 2 is reversed.

Thus, the negatively charged toner particles 16 will fly from the toner carrier roller 14 towards the control electrodes 4 in responses to the electric field formed by the voltage D applied to the on control electrodes 4 and then towards the back electrode 22 in response to the electric field formed by the voltage C applied to the back electrode 22.

Figure 11:
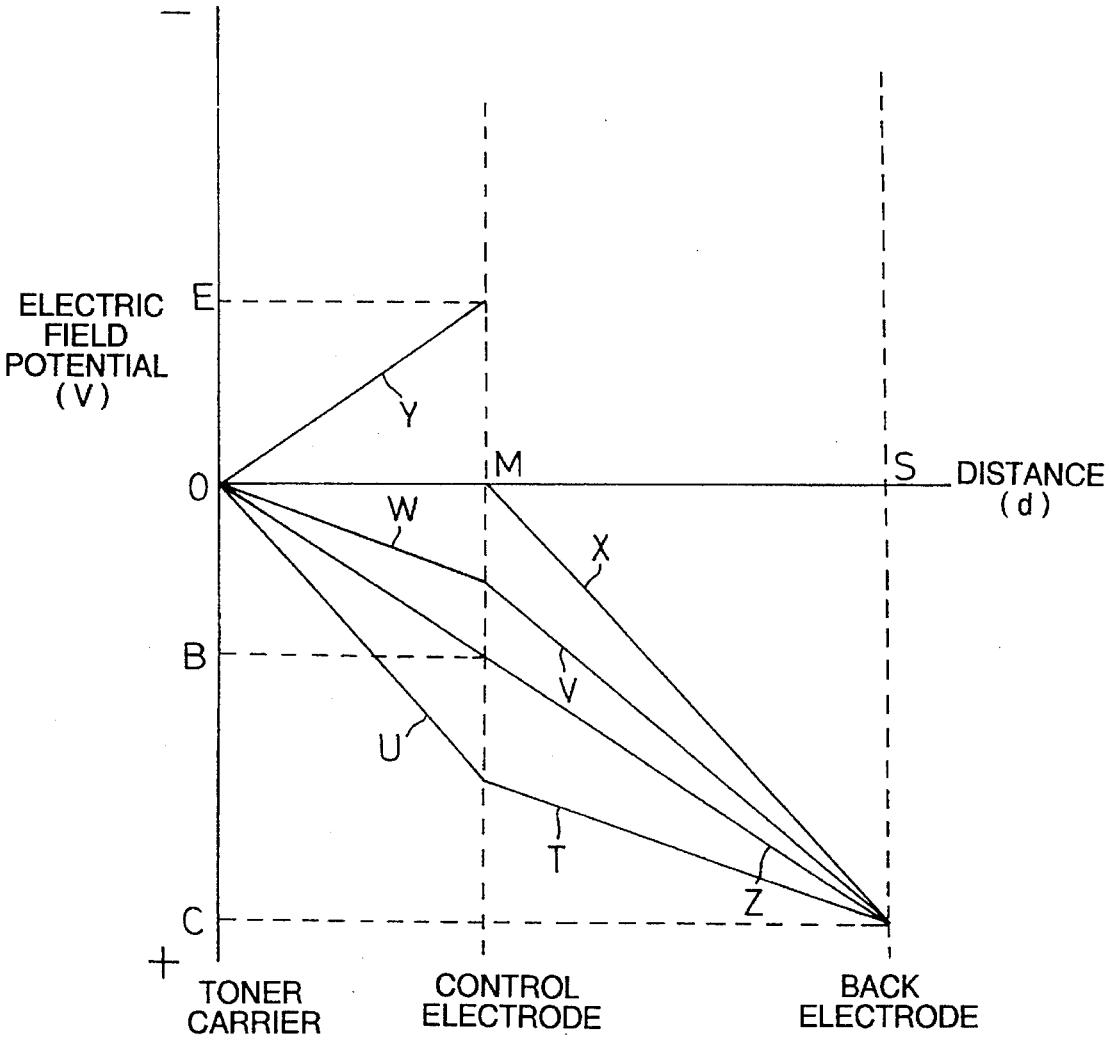
FIG. 11 is a graph showing the effective electric field gradients due to various voltages applied to the control electrodes and back electrode roller as a function of distance from the toner carrier roller.

This is generally shown in FIG. 11. In FIG. 11, since the toner particles 16 are negatively charged, the negative voltages are shown above the distance axis d and the positive voltages are shown below the distance axis d. Thus, when a negative voltage is applied to either the control electrodes 4 or the back electrode roller 22, the potential gradient from the toner carrier roller 14 to the control electrode 4 or the back electrode roller 22 is positive, indicating higher energy states as the toner particles 16 move from the toner carrier roller 14. Likewise, when a positive voltage is applied to either the control electrode 4 or the back electrode roller 22, the potential gradient from the toner carrier roller 14 is negative, indicating lower energy states as the toner particles 16 move from the toner carrier roller 14. Since the toner particles 16 will tend to move away from higher energy states and towards lower energy states, the toner particles 16 will tend to move along the negative potential gradients of FIG. 11 and will tend not to move along positive gradients of FIG. 11. Of course, it should be appreciated that if the toner particles 16 are positively charged, the shape of FIG. 11 would not change, but all of the polarities of the applied voltages and the areas of FIG. 11 would reverse.

As shown in FIG. 11, the gradient line Z between the toner carrier roller 14 and the back electrode roller 22 results from the voltage C being applied to the back electrode roller when the electrode aperture member 1 is absent, as shown in FIG. 10. The gradient line Y between the toner carrier roller 14 and the electrode aperture member 1 results when the control voltage D is set to a negative voltage for non-image (or off) control electrodes 4. Since the gradient line Y is positive, the toner particles 16 will tend to move from the off control electrodes 4 towards the toner carrier roller 14. Thus, no toner particles 16 will be pulled from the toner carrier roller 14 towards the off control electrodes 4. By preventing the flow of toner particles 16, the image quality of the non-image areas is improved. In addition, since the gradient line X between the on control electrodes 4 and the back electrode 22 is so steeply negative, any toner particles 16 which are in the vicinity of the control electrodes 4 when they are on are attracted towards the back electrode roller 22, thus preventing the toner particles 16 from clogging or otherwise adversely affecting the apertures 6.

In contrast, when the control voltage D applied to the image portion (or on) control electrodes 4 is between zero and B volts, the resulting potential gradient lines W and V are formed between the on control electrodes 4 and the toner carrier roller 14 and the back electrode roller 22, respectively. Since the potential gradient line W is negative, the toner particles 16 flow from the toner carrier roller 14 to the on control electrodes 4. Then, because the potential gradient line V from the on control electrodes 4 to the back electrode roller 22 is steeper than the potential line W, all of the toner particles 16 which flow from the toner carrier roller 14 to the on control electrodes 4 continue on to the back electrode 22. Thus, no toner particles 16 remain in the vicinity of the on control electrodes 4, and the apertures 6 are not clogged or otherwise adversely affected by the toner particles 16, thus improving the print quality.

However, if the control voltage D applied to the on control electrodes 4 were to be above B volts, the potential gradient lines U and T would result. Since the potential gradient line U is negative, toner particles 16 flow from the toner carrier roller 14 to the on control electrodes 4. However, since the potential gradient line U is steeper than the potential gradient line T, the toner particles 25 are not strongly attracted to the back electrode roller 22. Thus, not all of the toner particles 16 will flow from the on control electrodes 4 to the back electrode roller 22. Accordingly, the toner particles 16 remaining around the on control electrodes 4 will coat the surface of the aperture electrode member I and will clog and otherwise adversely affect the apertures 6, thus reducing the print quality.

In any of the above embodiments, positively charged toner particles can be used as the toner particles. In this case, a voltage having the same polarity as that of toner particles 16, i.e., a voltage of +100 V, may be applied to each control electrode 4 or 400 as an "off" control voltage to prevent the toner particles 16 from flying from the toner carrier roller 22 towards the control electrodes 4 or 400 or the back electrode roller 22. In this case, the potential to be applied to the back electrode roller 22 is also reversed, and thus is set to a negative potential. Likewise, if a non-zero voltage D is to be applied to the "on" control electrodes 4 or 400, it is also set to a negative potential.

In each of the aforementioned embodiments, the aperture electrode member I has been used as the toner-flow controlling means. However, a mesh-like electrode member, which has been described in U.S. Pat. No. 5,036,341, for example, may be used as an alternative to the aperture electrode member 1.

What is claimed is:

1. A method for controlling an image forming apparatus for forming an image on a substrate and having a toner-flow control means having a plurality of control electrodes and a back electrode, comprising the steps of:

supplying charged toner particles to the toner-flow control means;

applying a first control voltage to ones of the plurality of control electrodes of the toner-flow control means corresponding to image portions of the image, the first control voltage having a sign opposite to a sign of the charged toner particles;

applying a second control voltage to ones of the plurality of control electrodes corresponding to non-image portions of the image, the second control voltage having a sign which is the same as the sign of the charged toner particles;

determining an electric potential, at a position corresponding to a position of the toner-flow control means relative to the back electrode, due to a third control voltage to be applied to the back electrode, the third control voltage having a sign opposite to the sign of the charged toner particles;

comparing the determined electric potential to the applied first control voltage;

determining if the applied first control voltage is greater than the determined electric potential; and reducing the first control voltage to at most equal to the determined electric potential if the applied first control voltage is greater than the determined electric potential;

wherein, when the first and second control voltages are applied to the control electrodes, electric fields are generated around the control electrodes such that collection of the charged toner particles on the plurality of control electrodes is prevented.

2. The method of claim 1, wherein the first control voltage is determined based on a diameter of the control electrodes and a thickness of the toner-flow control means.

3. A method for controlling an image forming apparatus for forming an image on a substrate and having a toner-flow control means having a plurality of control electrodes and a back electrode, comprising the steps of:

supplying charged toner particles to the toner-flow control means;

applying a first control voltage to ones of the plurality of control electrodes of the toner-flow control means corresponding to image portions of the image, the first control voltage having a sign opposite to a sign of the charged toner particles;

applying a second control voltage to ones of the plurality of control electrodes corresponding to non-image portions of the image, the second control voltage having a sign which is the same as the sign of the charged toner particles;

determining an electric potential, at a position corresponding to a position of the toner-flow control means relative to the back electrode, due to a third control voltage to be applied to the back electrode, the third control voltage having a sign opposite to the sign of the charged toner particles; and setting the first control voltage to at most equal to the determined electric potential; wherein, when the first and second control voltages are applied to the control electrodes, electric fields are generated around the control electrodes such that collection of the charged toner particles on the plurality of control electrodes is prevented.

4. The method of claim 3, wherein the first control voltage is determined based on a diameter of the control electrodes and a thickness of the toner-flow control means.

5. A method for controlling an image forming apparatus for forming an image on a substrate and having a toner-flow control means having a plurality of control electrodes and a back electrode, comprising the steps of:

reading a next line of image data;

determining if at least one image pixel is to be formed on the image recording medium based on the read next line of image data;

applying a first control voltage to each one of the plurality of control electrodes corresponding to the at least one image pixel to be formed;

determining if at least one non-image pixel is to be formed on the image recording medium based on the read next line of image data;

applying a second control voltage to each one of the plurality of control electrodes corresponding to the at least one non-image pixel to be formed;

applying a third control voltage to the back electrode; and supplying charged toner particles from the toner supply means;

wherein, when the first and second control voltages are applied to the control electrodes, electric fields are generated around the control electrodes such that collection of the charged toner particles on the plurality of control electrodes is prevented, and when the charged toner particles are negatively charged, the third control voltage is positive, the second control voltage is negative, and the first control voltage is positive and at most equal to an electric potential, at a position corresponding to a position of the toner-flow control means relative to the back electrode, due to the third control voltage applied to the back electrode.

6. The method of claim 5, wherein the first electric potential is determined based on a diameter of the control electrodes and a thickness of the toner-flow control means.

7. A method for controlling an image forming apparatus for forming an image on a substrate and having a toner-flow control means having a plurality of control electrodes and a back electrode, comprising the steps of:

reading a next line of image data;

determining if at least one image pixel is to be formed on the image recording medium based on the read next line of image data;

applying a first control voltage to each one of the plurality of control electrodes corresponding to the at least one image pixel to be formed;

determining if at least one non-image pixel is to be formed on the image recording medium based on the read next line of image data;

applying a second control voltage to each one of the plurality of control electrodes corresponding to the at least one non-image pixel to be formed;

applying a third control voltage to the back electrode; and supplying charged toner particles from the toner supply means;

wherein, when the first and second control voltages are applied to the control electrodes, electric fields are generated around the control electrodes such that collection of the charged toner particles on the plurality of control electrodes is prevented, and when the toner particles are positively charged, the third control voltage is negative, the second control voltage is positive, and the first control voltage is negative and at most equal to an electric potential, at a position corresponding to a position of the toner-flow control means relative to the back electrode, due to the third control voltage applied to the back electrode.

8. The method of claim 7, wherein the first electric potential is determined based on a diameter of the control electrodes and a thickness of the toner-flow control means.

* * * * *